US010772412B2

(12) United States Patent
Tedder et al.

(10) Patent No.: US 10,772,412 B2
(45) Date of Patent: Sep. 15, 2020

(54) ADJUSTABLE SHOULDER HOLSTER

(71) Applicant: Tedder Industries, LLC, Post Falls, ID (US)

(72) Inventors: Thomas Tedder, Post Falls, ID (US); Drew Stephens, Coeur d'Alene, ID (US); Jacob Shearer, Post Falls, ID (US); Igor Shirobokov, Spokane, WA (US)

( * ) Notice: Subject to any disclaimer, the term of this patent is extended or adjusted under 35 U.S.C. 154(b) by 32 days.

(21) Appl. No.: 16/370,530

(22) Filed: Mar. 29, 2019

(65) Prior Publication Data

US 2019/0298039 A1 Oct. 3, 2019

Related U.S. Application Data

(60) Provisional application No. 62/650,761, filed on Mar. 30, 2018.

(51) Int. Cl.

| | |
|---|---|
| ***F41C 33/02*** | (2006.01) |
| ***A45F 3/14*** | (2006.01) |
| ***F41C 33/04*** | (2006.01) |
| *F42B 39/02* | (2006.01) |

(52) U.S. Cl.

CPC ..... *A45F 3/14* (2013.01); *F41C 33/046* (2013.01); *A45F 2003/142* (2013.01); *A45F 2003/148* (2013.01); *F41C 33/048* (2013.01); *F42B 39/02* (2013.01)

(58) Field of Classification Search

CPC .... F41C 33/041; F41C 33/043; F41C 33/045; F41C 33/046; F41C 33/048; F41C 33/02; F42B 39/02; A45F 3/14; A45F 2003/142; A45F 2003/148

See application file for complete search history.

(56) References Cited

U.S. PATENT DOCUMENTS

| | | | | | |
|---|---|---|---|---|---|
| 4,750,652 | A * | 6/1988 | Grant | A45F 5/00 | 224/579 |
| 4,903,874 | A * | 2/1990 | Shoemaker | A45F 3/14 | 2/327 |
| 5,018,653 | A * | 5/1991 | Shoemaker | F41C 33/0227 | 224/193 |
| 5,246,153 | A * | 9/1993 | Beletsky | A45F 3/14 | 224/192 |
| 5,358,160 | A * | 10/1994 | Bianchi | A45F 3/14 | 224/192 |
| 5,361,953 | A * | 11/1994 | Nichols | F41C 33/0227 | 224/192 |
| 5,642,847 | A * | 7/1997 | DeMeo | A45F 5/00 | 224/623 |
| 5,687,891 | A * | 11/1997 | Beletsky | F41C 33/0236 | 224/243 |
| 6,299,041 | B1 * | 10/2001 | Pitisi | A45F 5/021 | 224/197 |
| 2011/0233244 | A1 * | 9/2011 | Platts | F41C 33/046 | 224/243 |
| 2019/0219361 | A1 * | 7/2019 | Shorter | F41C 33/048 | |

* cited by examiner

*Primary Examiner* — Corey N Skurdal

(57) ABSTRACT

A shoulder holster assembly is used to support and to carry an implement in a holster. The shoulder holster assembly includes a base or an implement carrier removably coupled to a harness. The harness includes a plurality of length-adjustable straps with strap clips at the ends, configured to engage receivers in the base or the implement carrier.

20 Claims, 10 Drawing Sheets

ADJUSTABLE SHOULDER HOLSTER

PRIORITY CLAIM AND CROSS-REFERENCE TO RELATED APPLICATION

This application claims the benefit under 35 U.S.C. § 119(e)(1) of U.S. Provisional Application No. 62/650,761, filed Mar. 30, 2018, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

At times it can be desirable to carry an implement such as a handgun in various locations on the user, for instance on a shoulder rig over or underneath a layer of the user's clothing. However, when doing so, it is desirable that the holster provides versatility in accessing the handgun, as well as a high level of protection to the user and also to the handgun. For example, a holster that provides adequate protection but does not allow for a user's preferred draw position may not be acceptable.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
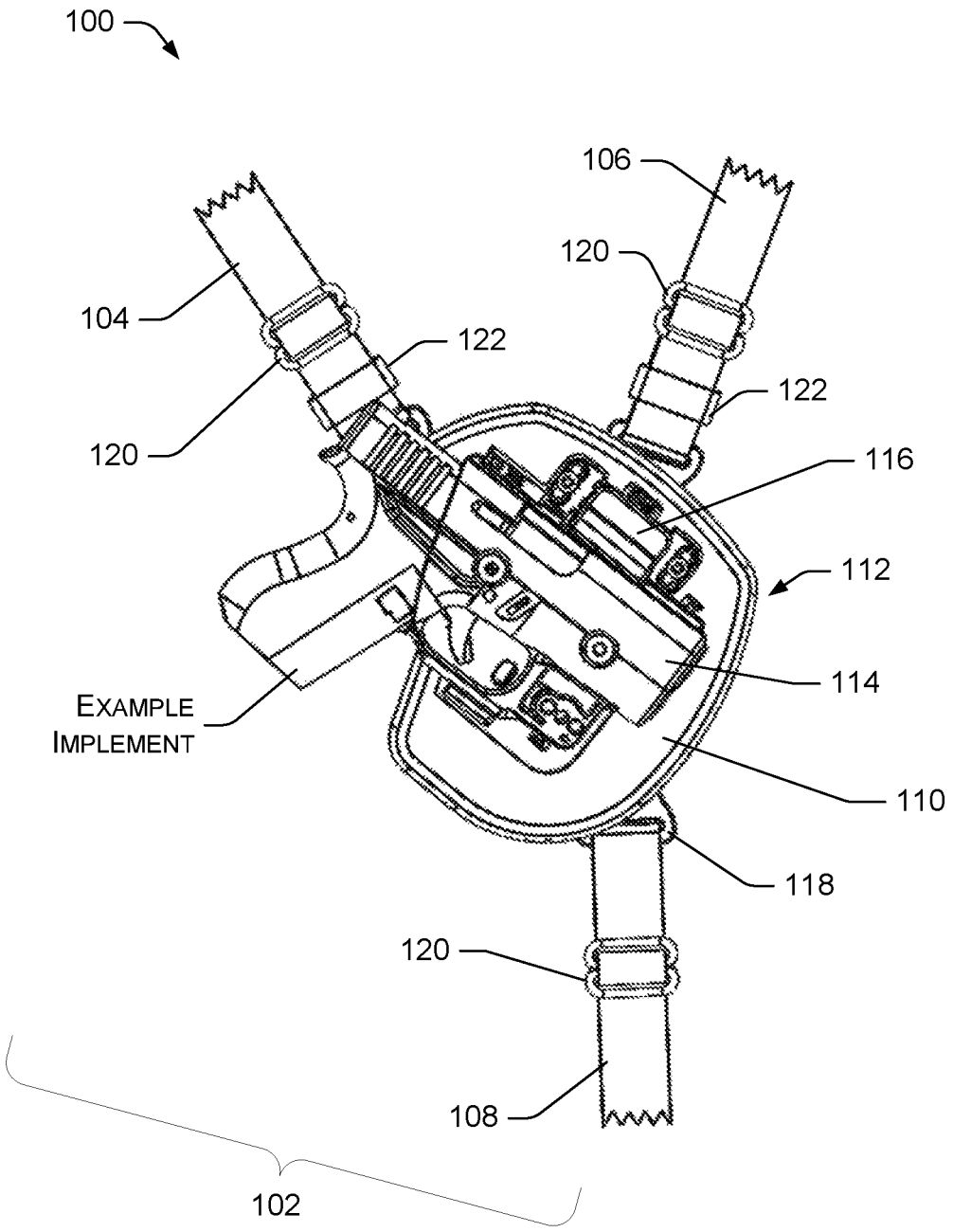
FIG. 1 shows a front view of an example adjustable shoulder holster assembly, according to an embodiment.

Representative implementations of devices and techniques provide an adjustable shoulder holster assembly to mount and to carry an implement (such as a handgun, for example) on the body of a user. The shoulder holster assembly is arranged to be worn on the back and shoulder(s) of the user, with a holster, carrier, or accessory under a user's arm (for example) for temporarily and safely carrying the implement or accessory, while making the implement or accessory easily accessible to the user. It can also be worn on another part of a user's person, or can be used to support an implement or implement holster in another location not on a user.

In various embodiments, the shoulder holster assembly 100 ("assembly 100") can be used with a holster (such as a holster shell, for example) coupled to the assembly 100. In various examples, a variety of holsters or holster shells may be removably or interchangeably coupled to the assembly 100 to carry different implements (e.g., handguns, accessories, etc.) with the assembly 100. One holster shell may be user-removed from the assembly 100, and another holster shell user-installed onto the assembly 100 to use the assembly 100 with a different handgun, for example. In one implementation, a selection of modular holster shells may be interchangeable with each other for coupling to the assembly 100, including holster shells configured for specific implements as well as generic holster shells that may fit a variety of implements.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, sheaths, containers, implements, tools, objects, and the like, and remain within the scope of the disclosure. For the purposes of this disclosure, the generic term "holster" is used to indicate any or all of the above.

Additionally, the techniques and devices as discussed may be used to support an implement or a carrier in various other manners (e.g., attached to a vehicle, an object of furniture, another object, etc.). In alternate implementations, the techniques and devices may be employed in other ways or with other devices, systems, instruments, or the like.

Further, the shape and quantity of the assembly 100 components illustrated in the figures may vary to accommodate various applications. In alternate embodiments, fewer, additional, or alternate components may be used and/or combined to form an assembly 100 or a shoulder holster system having equivalent function and operation.

Implementations are explained in more detail below using a plurality of examples. Although various implementations and examples are discussed here and below, further implementations and examples may be possible by combining the features and elements of individual implementations and examples.

Example Embodiments

As shown in FIGS. 1, 2, 3, and 6, an example adjustable shoulder holster assembly 100 may be comprised of a harness 102 that fits on the shoulders and back of the user, having straps (e.g., a front strap 104 and a back strap 106, as shown in the illustrations, or other alternate arrangements) extending over the user's shoulders and under the user's arms from the user's back to connect to a holster backer 110, or a holster 112, or other accessory carrier. An additional strap (a lower strap 108) may also be included and connect from the backer 110 (or holster 112) to the user's waistband, belt, or other article of clothing or accessory at the midsection of the user, for instance, to stabilize the shoulder holster assembly 100 on the user's person. In alternate embodiments, alternate or other straps may also be included.

Figure 2:
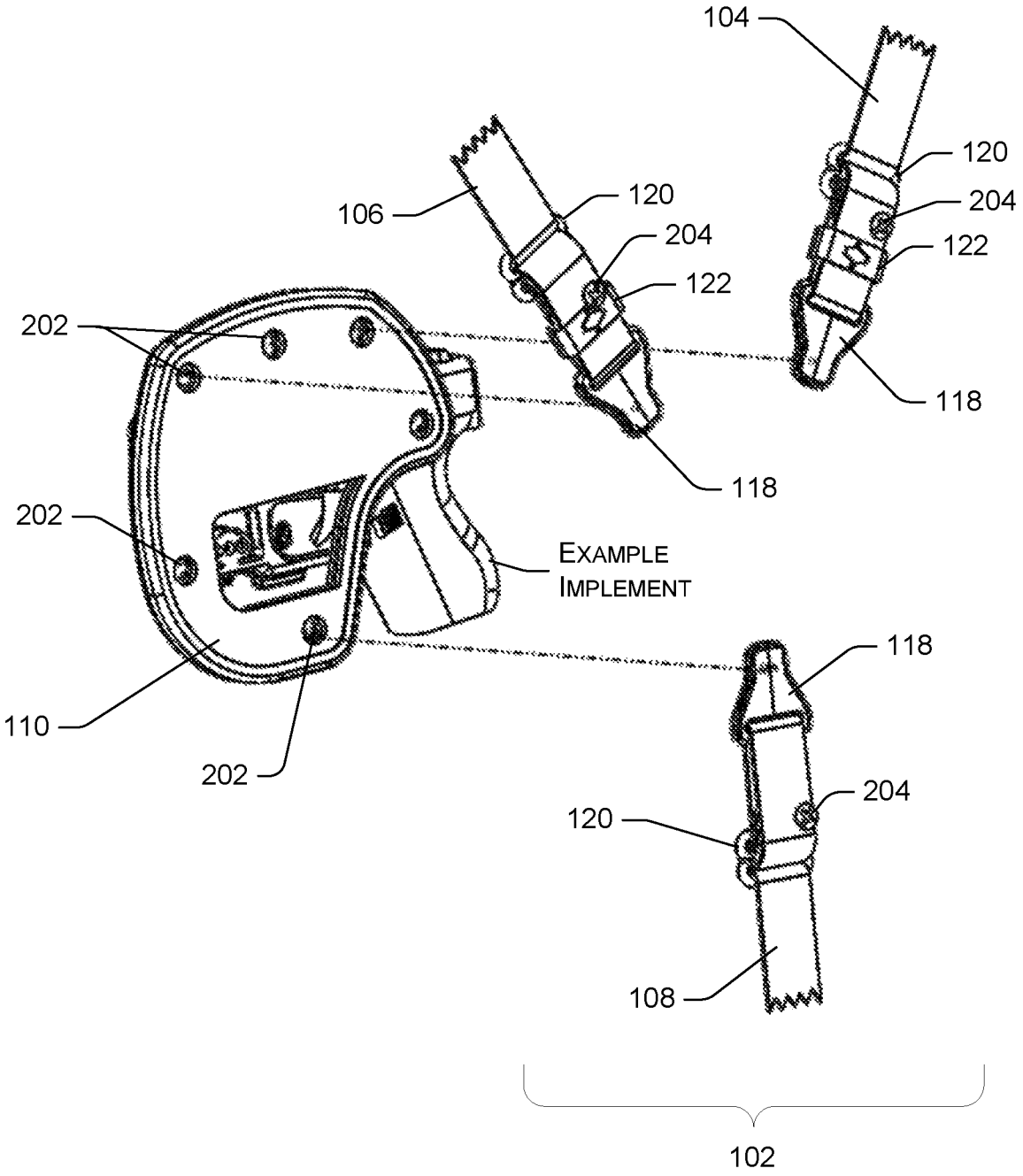
FIG. 2 shows a back view of an example adjustable shoulder holster assembly, according to an embodiment.
Figure 3:
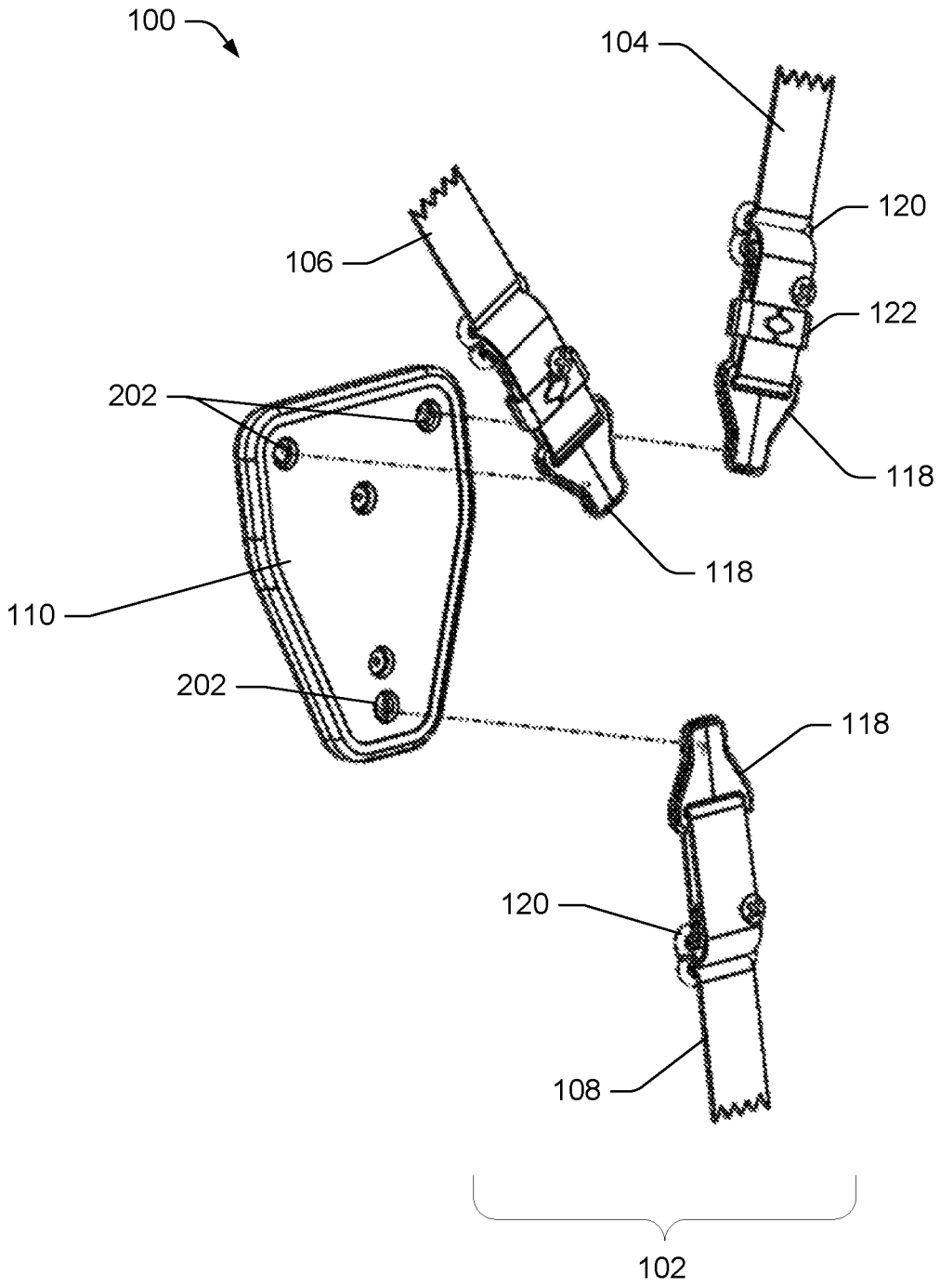
FIG. 3 shows a back view of an example adjustable shoulder holster assembly, according to another embodiment.

Referring to FIGS. 1, 2, and 3, the backer 110 may comprise a substantially planar base for a handgun holster, a tool carrier, a magazine carrier, or an accessory carrier, a base for a knife sheath, a padded or un-padded base, or various other like components. In various embodiments, the backer 110 may be made from one or more layers comprising animal hides, man-made materials such as formed polymers, or combinations of layers of each. As shown in FIGS. 2 and 3, a backer 110 may have varying shapes to accommodate a specific application or generic use. For instance, backers 110 for accessories (such as magazine carriers, pepper spray containers, etc.) may have a different size and shape than backers 110 for handguns, and the like.

In some cases, a multi-layer backer 110 may include a porous material to line the backer 110 where the backer 110 contacts the body of the user for comfort, performance, and so forth. Further, one or more layers may be included between the front layer of the backer 110 and the layer next to the user, including a padding layer, a stiffening or strengthening layer (such as a composite, polymer, or metal layer, for instance), or the like.

In various embodiments, the backer 110 may include one or more removable layers. For instance, one or more layers near the user may be removable from the backer 110 for cleaning, and so forth.

Figure 8:
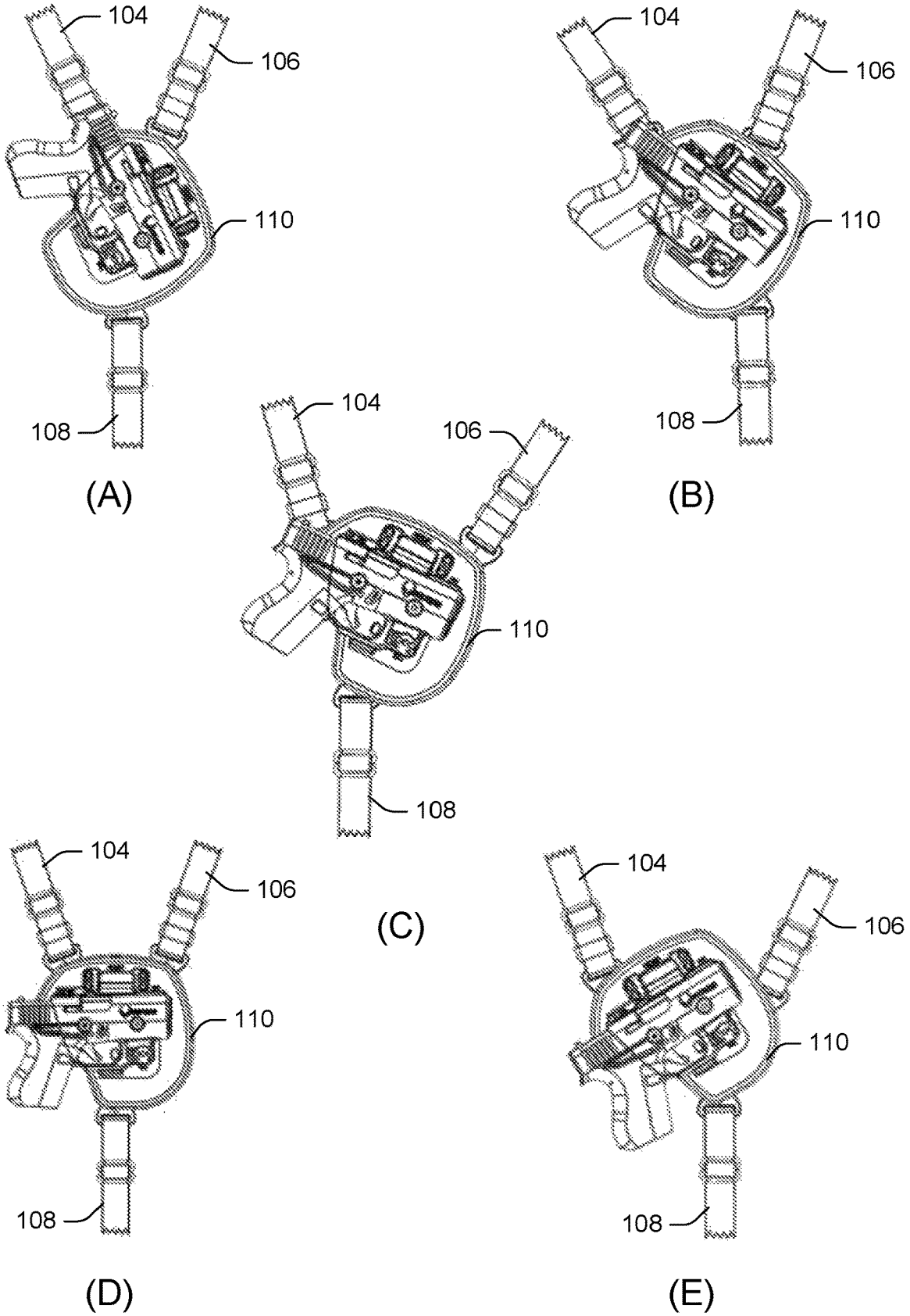
FIG. 8 shows five views of an example adjustable shoulder holster assembly with a holster shell, in five different cant positions, according to various implementations.

As shown in FIGS. 1 and 8, a holster shell 114, or the like, can be temporarily or permanently coupled to the backer 110 to form a holster 112. The addition of the holster shell 114 (or a partial shell) to the backer 110 forms a shoulder holster 112 for carrying (and perhaps concealing) the implement under the user's arm, with the weight of the implement and the holster 112 carried on the user's shoulders. In alternate embodiments, a single-piece holster 112 (or carrier, sheath, etc.) may be used in place of a backer/shell combination holster 112.

Figure 10:
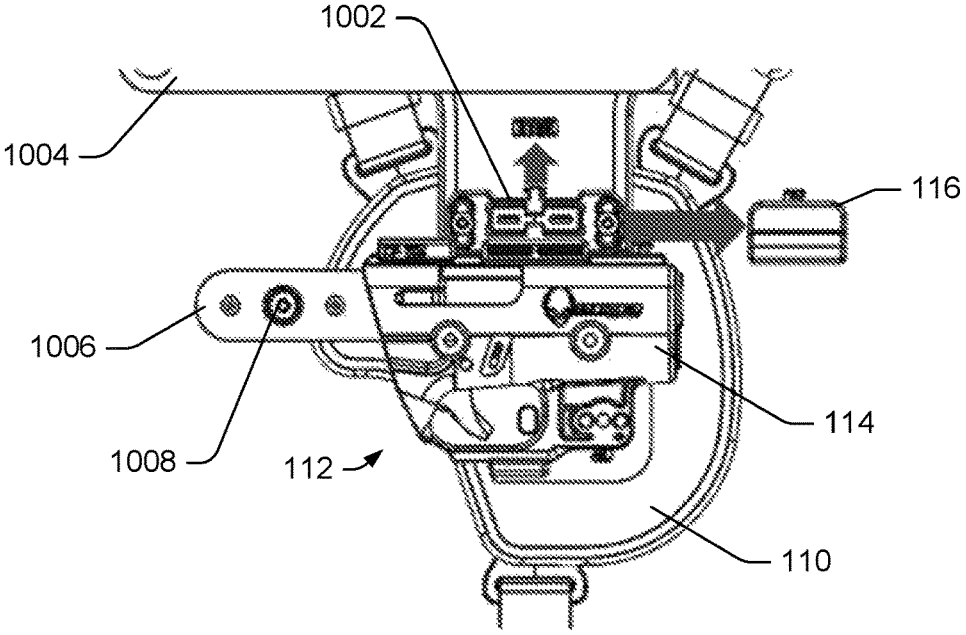
FIGS. 10 and 11 show views of holster shells on an example adjustable shoulder holster assembly, and including a shell cover, according to an implementation.

In an implementation, the holster shell 114 comprises a removable, modular plastic shell section formed using an injection molding process to conform to the shape of at least a portion of the implement. In other implementations, the holster shell 114 comprises a thermoformed plastic shell, a natural or synthetic leather pouch, or any other container made from one or more polymers, metals, composites, natural or synthetic hides, textiles, and so forth. In some cases, the holster shell 114 may be directly coupled to the backer 110 via screws, bolts, or other suitable fasteners. In other embodiments, the holster shell 114 may be coupled to the backer 110 via a locking fixture 116, or the like, as shown in FIGS. 1 and 10. In various embodiments, different holster shells 114 (or the like) can be interchanged on the backer 110 to accommodate different implements to be carried. For example, one holster shell 114 can be removed from the backer 110, and another holster shell 114 (or the like) can be coupled to the backer 110 when the user desires to carry a different handgun, for instance. This is illustrated in FIG. 10, for example, where a locking device 116 is released from a locking fixture 1002 to remove the holster shell 114. When a holster shell 114 (or the like) is replaced on the backer 110 via the locking fixture 1002, the locking device 116 may be used to secure the shell 114 to the backer 110.

The straps 104, 106, and/or 108 of the harness 102 may be comprised of natural or man-made materials, including natural or synthetic leathers, high strength or ballistic textiles (aramids), or combinations of materials. The straps 104, 106, and/or 108 may be attached to the holster backer 110 (or holster 112, etc.) using various removable fasteners or fastening techniques. In some embodiments, the straps 104, 106, and/or 108 may be coupled to the backer 110 (or holster 112, etc.) so as to be free to partially or fully pivot at the fastener locations.

As shown in FIGS. 1-5, 7 and 8, in some embodiments, a strap clip 118 is secured at the ends of the straps 104, 106, and/or 108. For instance the clip 118 may be coupled to at least one end of each strap 104, 106, and/or 108, offering a connection point to the holster backer 110 (or holster 112 or accessory carrier, etc.). In some arrangements, one or more of the straps 104, 106, and/or 108 may have a strap clip 118 at both ends of the strap 104, 106, and/or 108.

In an implementation, each strap clip 118 is coupled to a respective strap 104, 106, and/or 108 in an adjustable manner. For example, the strap 104, 106, and/or 108 may thread through a slot in the strap clip 118, or the like, fastening back on itself using one or more adjustable strap adjusters 120, or the like, for instance. This allows for infinite adjustments over the length of the respective strap 104, 106, and/or 108, and for a user-specific fit.

Figure 4:
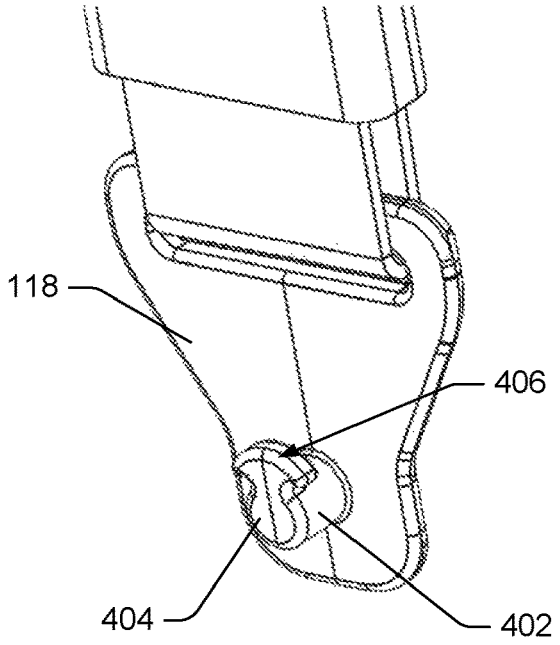
FIG. 4 shows a view of an example strap clip, according to an implementation.
Figure 5:
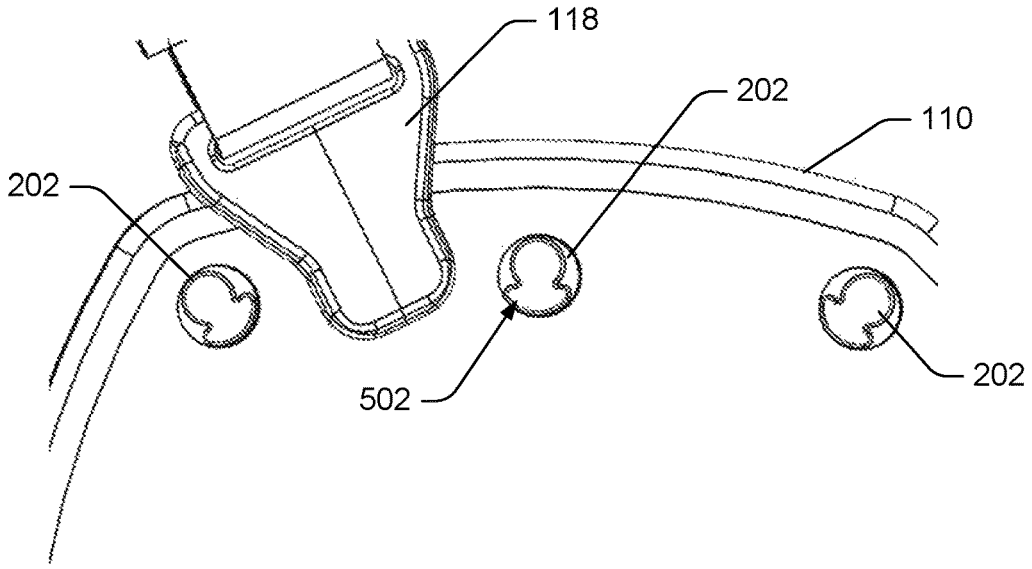
FIG. 5 shows a view of an example strap clip and attachment locations for the strap clips on an example backer, according to an implementation.
Figure 6:
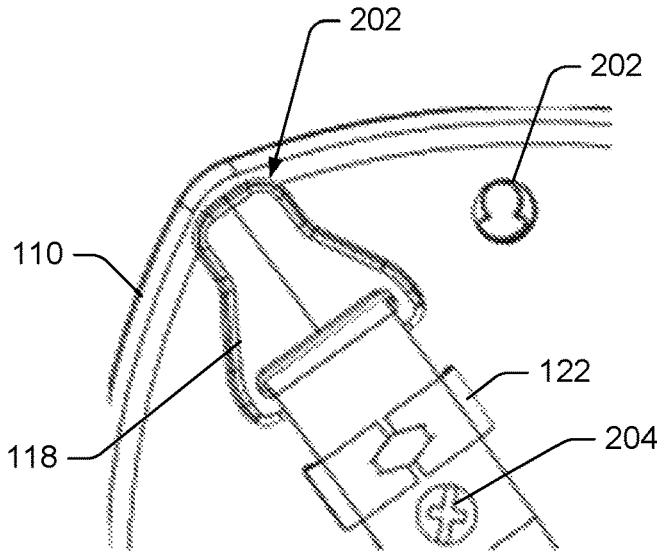
FIGS. 6 and 7 show views of example strap clips, and a technique for removing and attaching the strap clips, according to an implementation.
Figure 7:
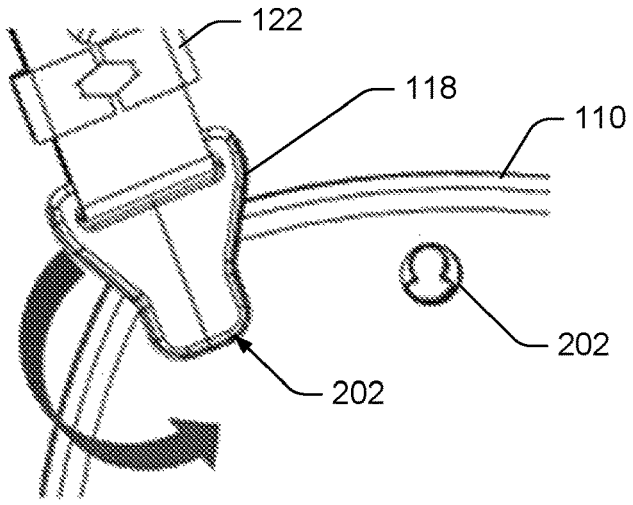

In some implementations, the straps 104, 106, and/or 108 may be removably coupled to the backer 110 (or holster 112, etc.) using strap clips 118 having a quick-disconnect technique that is secure, and also allows quick and easy reconfiguration of the harness 102 for user convenience. In an embodiment, as shown in FIG. 4, one part of the strap clip 118 includes a male attachment portion, including a post or shaft 402, with a key 404 at the end of the shaft 402. In the embodiment, the male key 404 of the clip 118 matches a female feature 202 (key hole) of the holster backer 110 (or holster 112, etc.), offering quick and easy connection and disconnection of the strap 104, 106, and/or 108 to the holster backer 110 (or holster 112, etc.) with no tool required. In an alternate embodiment, the male key 404 may be on the backer 110 (or holster 112, etc.) and the female feature 202 may be on the strap clips 118.

As shown in FIGS. 4-6, and 9, the keyholes 202 arranged in the backer 110 (or holster 112, etc.) are receivers for the key 404/shaft 402 combination of the strap clips 118, allowing quick connect/disconnect of the strap clips 118 to the backer 110 (or holster 112, etc.). The unique shape of the male key 404 on the clip 118 closely matches the shape of the female keyhole feature 202. The key 404 shape and keyhole 202 shape may be any suitable shape (elliptical, polygonal, irregular, etc.) that allows the locking function described herein. For example, the key 404 may include a uniquely shaped tab portion 406 that closely fits a similarly shaped portion 502 of the keyhole 202 when aligned.

Accordingly, as shown in FIGS. 4-8, a strap 104, 106, and/or 108 is attached to the backer 110 (or holster 112, etc.) by aligning the male key 404 with a female keyhole 202 on the backer 110 (or holster 112, etc.), inserting the key 404 and shaft 402 through the keyhole 202, and then rotating the clip 118 to engage the key 404 and prevent non-intentional disconnection. In various embodiments, the rotation may be varying degrees (30, 45, 90, 180, etc.) to lock the key 404 in the keyhole 202. The shape of the key 404 is closely matched to the shape of the keyhole 202, so the key 404 must be aligned well to the keyhole 202 to pass through the keyhole 202 and will not pass through the keyhole 202 if offset, misaligned, or rotated out of alignment. Accordingly, the shape of the key 404 with respect to the keyhole 202 also prevents the key 404 from backing out of the keyhole 202 once the clip 118 has been inserted and rotated.

To remove the key 404 (and thus the strap clip 118), the clip 118 is rotated again, which rotates the shaft 402 and key 404, to realign the key 404 with the shape of the keyhole 202. Once the shape of the key 404 is aligned to the shape of the keyhole 202, the key 404 can then be pulled from the keyhole 202. This removes the clip 118 and associated strap 104, 106, and/or 108 from the backer 110 (or holster 112, etc.), without the use of tools. In some embodiments, the clip 118 is rotated a first direction to attach the clip 118 to the backer 110 (or holster 112, etc.) and is rotated an opposite direction to detach the clip 118 from the backer 110 (or holster 112, etc.). In other embodiments, the clip 118 may be rotated in either direction to attach and detach the clip 118.

In alternate embodiments, the clip 118 may be pressed into the keyhole 202 (or a like feature) of the backer 110, without rotation of the clip 118. For example, other fastener techniques and devices may be used to attach the clips 118 to the backer 110 (e.g., snaps, hooks, clasps, etc.).

The quick-change strap clips 118 allow the user to quickly interchange the backers 110, bases, etc. that are attached to the harness 102 (i.e., the straps 104, 106, and/or 108) of the shoulder holster assembly 100, without tools. For example, the user may exchange holsters, holster backers, accessory carriers, or accessory backers on the shoulder holster assembly 100 as desired. Changing the backer 110 (or holster 112, accessory, etc.) of the shoulder holster assembly 100 for another holster backer 110, magazine accessory, or the like, comprises removing the straps 104, 106, and/or 108 from the current backer 110 and attaching the straps 104, 106, and/or 108 to the other backer 110, holster 112, etc. This is done by disengaging the clips 118 from the backer 110 (or holster 112, etc.) as described above, and engaging the clips 118 to the replacement backer 110 (or holster 112, etc.).

In addition, as shown in FIGS. 4-9, the shoulder holster assembly 100 can be reconfigured without the use of tools as desired. For example, the strap clips 118 can be moved to different keyhole 202 positions on the backer 110 (or holster 112, etc.) to adjust the carry angle, or cant of the holster 112. In various embodiments, the backer 110 (or holster 112, etc.) includes multiple female keyholes 202 at different positions around the perimeter of the backer 110 (or holster 112, etc.). The multiple keyhole 202 positions allow the user to select different cants or positions/orientations for the holster 112, based on the keyholes 202 selected for the strap 104, 106, and/or 108 connections. This also allows the user to adjust the cant of the holster 112 or carrier as desired for comfort or function.

Figure 9:
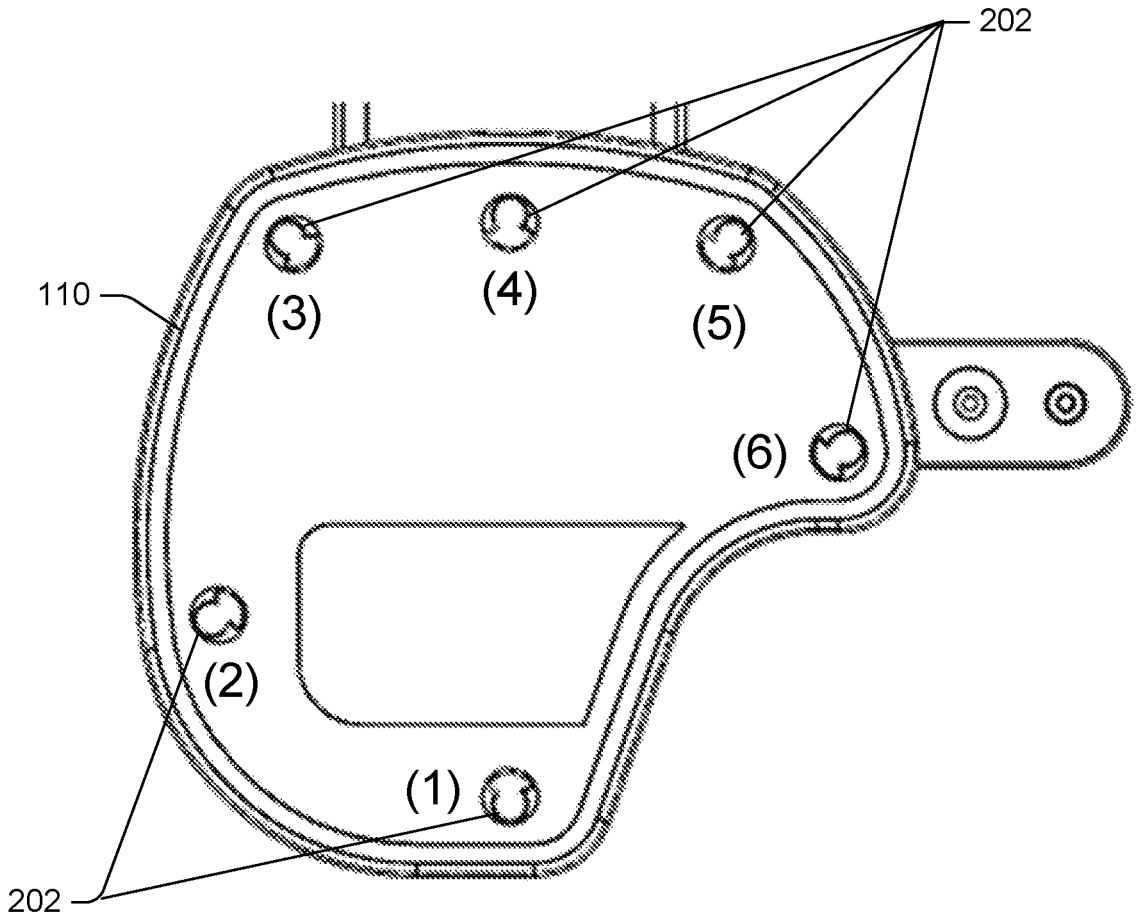
FIG. 9 shows a backer with multiple strap clip locations, for making various cant adjustments to an example adjustable shoulder holster assembly, according to an implementation.

As shown in FIG. 8, at least five different carry angles or cants (from positive angles to horizontal to negative angles) are possible in the one example implementation shown. In an embodiment, the various carry angles of FIG. 8 are made possible by coupling the straps 104, 106, and/or 108 onto the backer 110 (via the strap clips 118) by selecting from the various keyhole 202 positions in the backer 110, as shown at FIG. 9. For instance, referring to FIGS. 8 and 9, attaching the straps 104, 106, and/or 108 at different keyhole 202 locations (e.g., locations 1-6) causes the backer 110 (or holster 112, etc.) to be at a different rotational angle when worn on the user, or otherwise suspended from the straps 104, 106, and/or 108.

In an example, the vertical carry angle shown at FIG. 8(A) may be achieved by attaching the front 104 and back 106 straps at keyhole 202 locations 6 and 5, and attaching the lower strap 108 at keyhole 202 location 2. The canted vertical carry angle shown at FIG. 8(B) may be achieved by attaching the front 104 and back 106 straps at keyhole 202 locations 6 and 4, and attaching the lower strap 108 at keyhole 202 location 2.

The canted horizontal carry angle shown at FIG. 8(C) may be achieved by attaching the front 104 and back 106 straps at keyhole 202 locations 6 and 3, and attaching the lower strap 108 at keyhole 202 location 1. The horizontal carry angle shown at FIG. 8(D) may be achieved by attaching the front 104 and back 106 straps at keyhole 202 locations 5 and 3, and attaching the lower strap 108 at keyhole 202 location 1. The negative canted carry angle shown at FIG. 8(E) may be achieved by attaching the front 104 and back 106 straps at keyhole 202 locations 5 and 2, and attaching the lower strap 108 at keyhole 202 location 1.

In various implementations, additional and/or alternate carry angles not illustrated are also possible by attaching the front 104 and back 106 straps at different keyhole 202 location combinations. Also, the lower strap 108 can be optional in all of the above examples, as well as with other combinations. Further carry angles are also possible by adding more keyholes 202 to the backer 110 (or holster 112, etc.) or by a change to the location of the various keyholes 202 on the backer 110 (or holster 112, etc.), for example.

In some cases, the keyhole 202 location for the front 104 and back 106 straps may depend on whether the backer 110 (or holster 112, etc.) is intended for the right side or the left side of the user. In some embodiments, a backer 110, or holster 112, carrier, etc. may be worn on each side of the user, as further described below. Additionally, a backer 110 (or holster 112, etc.), including keyhole 202 positions, intended for the right side of a user may be a mirror image of a backer 110 (or holster 112, etc.) intended for the left side of a user, including respective keyhole 202 positions.

In alternate embodiments, a backer 110 (or holster 112, etc.) may have fewer or more keyholes 202, or may have keyholes 202 in different locations on the backer 110 (or holster 112, etc.). In further implementations, the keyholes 202 of a backer 110 (or holster 112, etc.) and corresponding clips 118 of the straps 104, 106, and/or 108 may have different sizes or shapes from each other, as a way to guide or guarantee that a particular strap 104, 106, and/or 108 is to be mounted to the backer 110 (or holster 112, etc.) at a particular keyhole 202 position, or to one of a range of predetermined keyhole 202 positions that fit the key 404. For instance, a keyhole 202 may have a size and shape that allows the clips 118 of one or more straps 104, 106, and/or 108 to be mounted at that keyhole 202 location, but not others.

Figure 11:
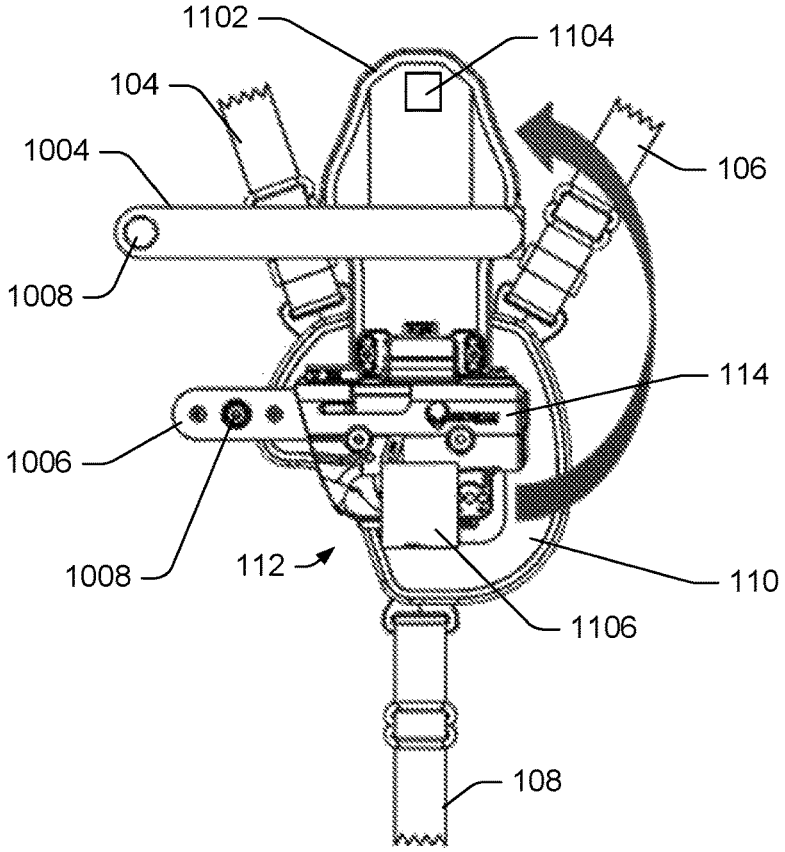

As shown in FIG. 11, the shoulder holster assembly 100 may include a shell cover 1102 (shown in an open configuration), which may be used to cover over the holster shell 114, providing a smoother surface for the user's arm, and a cleaner appearance. The shell cover 1102 may be positioned over the holster shell 114 (folded over the holster shell 114, for instance) and secured to the backer 110 or holster shell 114 using one or more fasteners (e.g., snaps, hook and loop fasteners, magnets, etc.). For example, the shell cover 1102 may include one or more first fasteners 1104 (or portions of fasteners 1104), and the holster shell 114 or the backer 110 may include one or more second fasteners 1106 (or portions of fasteners 1106) to mate with the first fasteners 1104. If the shell cover 1102 is present, the shell cover 1102 may be opened, removed, or the like, to reveal the holster shell 114 and/or locking mechanisms 116, so that the holster shell 114 may be removed, interchanged, and so forth.

In an implementation, as shown in FIGS. 10 and 11, the shoulder holster assembly 100 may include a retention strap (i.e., thumb-break), for example comprising an upper retention strap 1004 and a lower retention strap 1006, configured to retain the implement within the holster 112, preventing accidental removal of the implement. As shown in FIGS. 10 and 11, the upper retention strap 1004 may be coupled to the shell cover 1102 and the lower retention strap 1006 may be coupled to the backer, for example. In alternate embodiments, the upper 1004 and lower 1006 retention straps may be coupled to other portions of the shoulder holster assembly 100.

In the illustrations of FIGS. 10 and 11, the fastener 1008 (or portion of fastener 1008) of the upper retention strap 1004 fastens to another fastener 1008 (or other portion of fastener 1008) on the lower retention strap 1006. When the shell cover 1102 is closed, the upper retention strap 1004 is fastened to the lower retention strap 1006 using the fasteners 1008, with the upper 1004 and lower 1006 retention straps looped around a rear portion of the implement, trapping the implement in the holster 112, until intentionally released. Various other options, including a single retention strap or additional retention straps or devices are contemplated and included within the scope of the disclosure.

Figure 12:
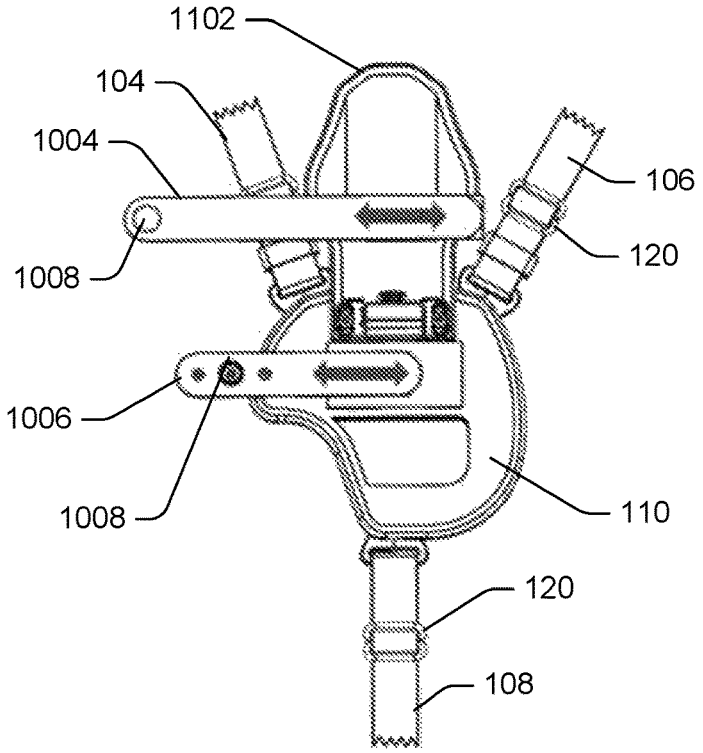
FIGS. 12-14 illustrate techniques for adjusting various straps on an example adjustable shoulder holster assembly, according to an implementation.

As shown in FIG. 12, in some embodiments, the upper retention strap 1004 and/or the lower retention strap 1006 may be adjustable (by moving all or a portion of the upper retention strap 1004 and/or the lower retention strap 1006 inward or outward relative to the shell cover 1102 and the backer 110, respectively, or extending and retracting the upper 1004 and/or lower 1006 retention straps) to fit a variety of holster shells 114, implements, and the like. In the embodiments, the upper 1004 and/or lower 1006 retention straps may be moveably coupled to the shell cover 1102 and/or the backer 110 (or other locations of the assembly 100, if applicable).

Figure 13:
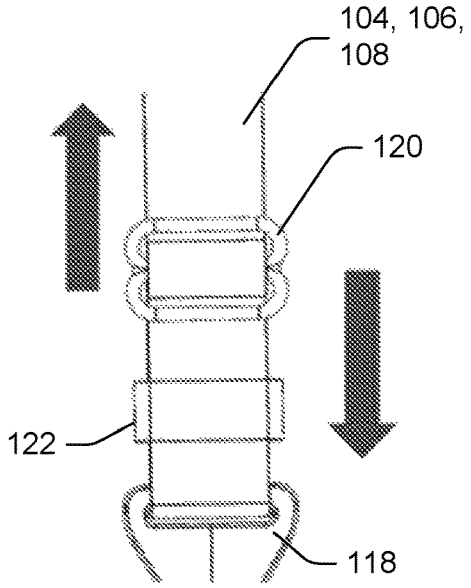
Figure 14:
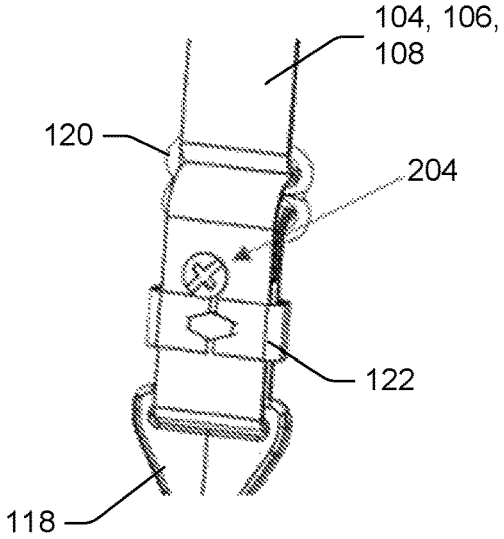

As shown in FIGS. 13 and 14, any or all of the straps 104, 106, and/or 108 may be length adjustable to fit the user's body, using strap adjusters 120 and slides 122 as shown, or the like. The straps 104, 106, and/or 108 can be adjusted to be shorter by sliding the slide 122 away (shown in the illustration as upward) from the strap clip 118. The straps 104, 106, and/or 108 can be adjusted to be longer by sliding the slide 122 towards (shown in the illustration as downward) the strap clip 118. In the embodiment, the slide 122 is coupled to a portion of the strap 104, 106, and/or 108, so that moving the slide 122, moves a portion of the strap 104, 106, and/or 108.

For greater adjustment, the overall length of the strap 104, 106, and/or 108 can be adjusted using the binding screw 204 (or a like fastener). To adjust, remove the binding screw 204 in the back of the strap 104, 106, and/or 108, adjust the length of the strap 104, 106, and/or 108, and install the binding screw 204 at the new position.

Figure 15:
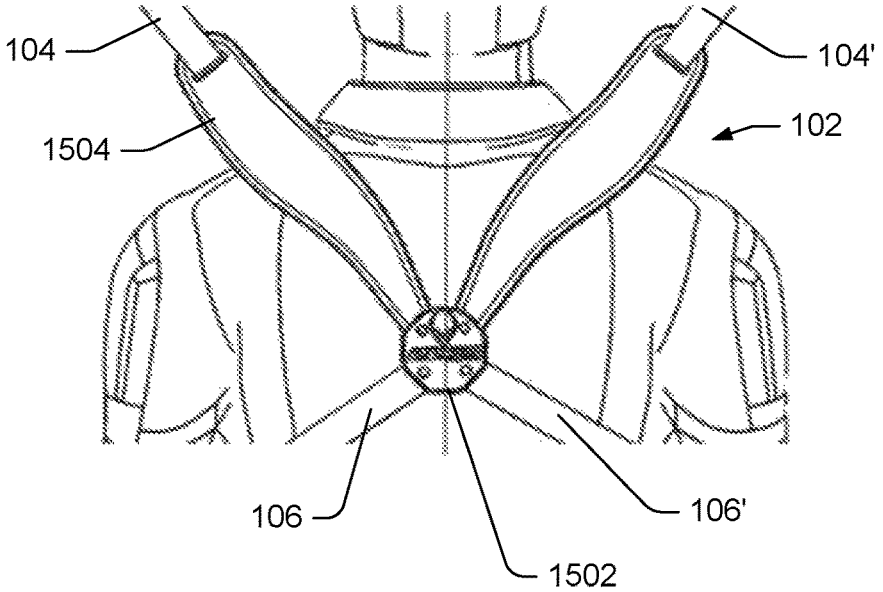
FIGS. 15 and 16 illustrate techniques for adjusting fitment of an example adjustable shoulder holster assembly, according to an implementation.

Referring to FIG. 15, in various embodiments, the harness 102 may include a back connector 1502 arranged to be a connection point for the front 104 and back 106 straps. For instance, the front 104 and back 106 straps may be permanently or removably coupled to the back connector 1502 in various embodiments. The back connector 1502 may have various shapes, sizes and configurations for coupling the front 104 and back 106 straps. In an alternate implementation, the ends of the front 104 and back 106 straps are coupled together without a back connector 1502.

As shown in FIG. 15, the front 104 (and back 106) straps may also include a pad 1504, or the like, either disposed over the front 104 (and optionally back 106) straps or attached to the ends of the front 104 (and back 106) straps. In the latter case, the pad 1504 may be coupled to the back connector 1502 or coupled to the pad 1504 or end of the other of the back 106 and front 104 straps. The pad 1504 can provide greater comfort for the user over longer periods of wearing the harness 102.

In an implementation, as shown in FIG. 15, the harness 102 may include a pair of front straps (104 and 104') and a pair of back straps (106 and 106') for additional carrying capacity or for comfort. Optionally, the harness 102 may include a pair of lower straps (108 and 108,' not shown). In an embodiment, the lower straps (108 and/or 108') may be coupled to an article of the user's clothing, an accessory, or the like, using a fastener, such as a clip, a clamp, or any other removable fastener. The lower straps (108 and/or 108') may be coupled at the mid-section of the user to stabilize the harness 102.

Figure 16:
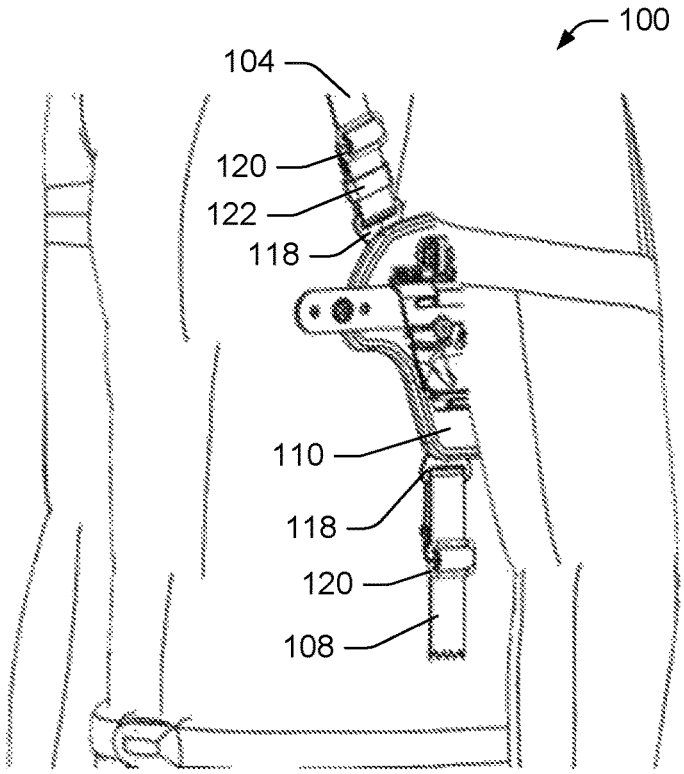

In various implementations, the adjustable shoulder holster assembly 100 can include one implement holster 112 (such as a handgun holster, knife sheath, or the like) or accessory carrier (such as a magazine carrier, tool carrier, or the like) under one arm (as shown in FIG. 16), or it can include an implement holster 112 or accessory carrier under each arm (not shown). In either case, the various strap adjusters 120, along with slides 122 and binding screws 204, if present, can offer infinite and secure adjustments to the straps 104, 106, and/or 108 to provide a perfect fit for a user, as shown in FIG. 16.

The assembly 100 is convertible to allow the user to quickly and easily exchange holsters 112, holster backers 110, accessory carriers, or the like, at each of the arm positions (e.g., right and left arm positions) of the assembly 100. The ease of convertibility and adjustability is made possible by the use of the unique strap clips 118, where the interchangeable holsters 112, holster backers 110, accessory carriers, or the like, include one or more attachment locations 202 to interface with the strap clips 118.

In various implementations, an assembly 100 may include additional or alternate components, or have different shapes or sizes than those illustrated. The assembly 100 components disclosed herein have been illustrated to be used with handgun holsters 112 and holster shells 114. However, the assembly 100 components disclosed herein may also be used with the holders or cases of any tools or implements. Further, the shoulder holster assembly 100 may be used to secure or mount any of various items, and particularly where concealed carry on a body of the user are desired.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A holster assembly for carrying an implement, comprising:

a harness comprising a plurality of length-adjustable straps;

a plurality of strap clips, each strap clip of the plurality coupled to a first end of each strap of the plurality of straps, each strap clip including a male key portion; and a backer for an implement carrier or an implement carrier, the backer or implement carrier including a plurality of female key receivers, each male key portion of the plurality of strap clips adapted to fit into a female key receiver to selectively couple the plurality of straps to the backer or implement carrier in one of multiple configurations based on spatial positions of the female key receivers and depending on which female key receivers of the plurality are selected to receive the male key portions.

2. The holster assembly of claim 1, further comprising a modular holster shell removably coupled to the backer and adapted to enclose at least a portion of the implement.

3. The holster assembly of claim 1, wherein the harness includes a front strap configured to be worn over a first shoulder of a person and a back strap configured to be worn at a back of the person, the front strap and the back strap coupled at a location at the back of the person.

4. The holster assembly of claim 3, further comprising a second front strap configured to be worn over a second shoulder of the person and a second back strap configured to be worn at the back of the person, the second front strap and the second back strap coupled at a location at the back of the person.

5. The holster assembly of claim 4, further comprising a back connector configured to couple together the front strap, the second front strap, the back strap, and the second back strap at the back connector.

6. The holster assembly of claim 3, further comprising a lower strap configured to be worn at a side of the person, and to couple the backer or implement carrier to an article of clothing at a midsection of the person.

7. The holster assembly of claim 1, further comprising multiple interchangeable backers configured to couple to the harness.

8. The holster assembly of claim 1, wherein a quantity of female key receivers of the backer is equal to or greater than a quantity of straps of the harness.

9. The holster assembly of claim 1, wherein a rotational angle of the backer relative to the harness is user adjustable by selecting a subset of female key receivers from the plurality of female key receivers to receive a male key portion.

10. The holster assembly of claim 1, wherein a rotational angle of the backer relative to the harness is user adjustable by moving a male key portion from a first female key receiver to a second female key receiver.

11. The holster assembly of claim 1, wherein a male key portion includes a tab portion that matches a feature shape of one or more female key receivers.

12. The holster assembly of claim 1, wherein a male key portion is temporarily locked to a female key receiver by inserting the male key portion into the female key receiver and rotating the male key portion a preselected angular rotation.

13. The holster assembly of claim 1, wherein the harness is adapted to be worn over at least one shoulder of a user.

14. The holster assembly of claim 1, wherein the harness is adapted to carry an implement or an accessory under one or both arms of a user.

15. A holster assembly for carrying an implement, comprising:

a harness comprising at least two length-adjustable straps, a front strap and a back strap;

a strap clip adjustably coupled to an end of each of the front strap and the back strap, each strap clip including a male key portion;

an implement carrier configured to enclose at least a portion of an implement, the implement carrier including a base configured to be removably coupled to the front strap and the back strap; and a quantity of female key receivers disposed on the base, each of the female key receivers adapted to receive a male key portion of a strap clip when a shape of the male key portion is aligned to a shape of the female key receiver, and configured to trap the male key portion when the male key portion is inserted into the female key receiver and rotated such that the shape of the male key portion is misaligned relative to the shape of the female key receiver.

16. The holster assembly of claim 15, further comprising a third length-adjustable lower strap, the lower strap including a strap clip at one end of the lower strap, configured to be inserted into a female key receiver of the base, and a fastener at another end of the lower strap, configured to be coupled to an article of clothing or accessory of a user.

17. The holster assembly of claim 15, further comprising a second front strap, a second back strap, and a second carrier, wherein the implement carrier is configured to be carried under a first arm of a user and the second carrier is configured to be carried under a second arm of the user.

18. The holster assembly of claim 15, wherein the quantity of female key receivers is greater than two, and wherein a relative rotational angle of the base is determined by selectively inserting a male key portion of a strap clip of the front strap into a first female key receiver and selectively inserting a male key portion of a strap clip of the back strap into a second female key receiver.

19. The holster assembly of claim 18, wherein a relative rotational angle of the base is adjusted by removing the male key portion of the strap clip of the front strap from the first female key receiver and selectively inserting the male key portion of the strap clip of the front strap into a third female key receiver and/or removing the male key portion of the strap clip of the back strap from the second female key receiver and selectively inserting the male key portion of the strap clip of the back strap into the third female key receiver or a fourth female key receiver.

20. A holster assembly for carrying an implement, comprising:

a harness comprising at least a pair of length-adjustable front straps and a pair of length-adjustable back straps coupled together via a back connector;

a strap clip adjustably coupled to an end of each of the front straps and the back straps, each strap clip including a post with a male key portion at the end of the post;

a first implement carrier configured to enclose at least a portion of an implement, the implement carrier including a base configured to be coupled to a first front strap and a first back strap;

a first plurality of female key receivers disposed on the base, each female key receiver of the first plurality of female key receivers configured to receive a male key portion of a strap clip when a shape of the male key portion is aligned to a shape of the female key receiver, and configured to trap the male key portion when the male key portion is inserted into the female key receiver and rotated such that the shape of the male key portion is misaligned relative to the shape of the female key receiver; and a second carrier configured to be coupled to a second front strap and a second back strap; and a second plurality of female key receivers disposed on the carrier, each female key receiver of the second plurality of female key receivers configured to receive a male key portion of a strap clip when a shape of the male key portion is aligned to a shape of the female key receiver, and configured to trap the male key portion when the male key portion is inserted into the female key receiver and rotated such that the shape of the male key portion is misaligned relative to the shape of the female key receiver.

* * * * *